US007581802B2

(12) United States Patent
Tabata et al.

(10) Patent No.: US 7,581,802 B2
(45) Date of Patent: Sep. 1, 2009

(54) LIQUID JET APPARATUS, PRINTING APPARATUS, AND METHOD OF ADJUSTING PHASE OF DRIVE PULSE

(75) Inventors: Kunio Tabata, Shiojiri (JP); Toshiyuki Suzuki, Shiojiri (JP); Atsushi Oshima, Shiojiri (JP); Osamu Shinkawa, Chino (JP); Tomoki Hatano, Higashiomi (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 11/780,301

(22) Filed: Jul. 19, 2007

(65) Prior Publication Data

US 2008/0018685 A1 Jan. 24, 2008

(30) Foreign Application Priority Data

Jul. 20, 2006 (JP) ..... 2006-198207
Jul. 11, 2007 (JP) ..... 2007-181649

(51) Int. Cl.
*B41J 29/38* (2006.01)

(52) U.S. Cl. ..... 347/14; 347/11; 347/48

(58) Field of Classification Search ..... 347/10, 347/11, 14, 48, 57
See application file for complete search history.

(56) References Cited

U.S. PATENT DOCUMENTS

| | | | | |
|---|---|---|---|---|
| 6,267,519 | B1 * | 7/2001 | Otsuki et al. | 400/283 |
| 6,312,096 | B1 * | 11/2001 | Koitabashi et al. | 347/40 |
| 6,364,443 | B1 * | 4/2002 | Katano et al. | 347/9 |
| 6,652,055 | B2 * | 11/2003 | Oikawa | 347/9 |
| 6,776,469 | B2 * | 8/2004 | Nozawa | 347/14 |
| 7,244,007 | B2 | 7/2007 | Ishizaki | |
| 2005/0231179 | A1 | 10/2005 | Ishizaki | |
| 2008/0018683 | A1 | 1/2008 | Oshima et al. | |
| 2008/0018686 | A1 | 1/2008 | Oshima et al. | |
| 2008/0018687 | A1 | 1/2008 | Tabata et al. | |
| 2008/0100652 | A1 | 5/2008 | Oshima et al. | |
| 2008/0218545 | A1 | 9/2008 | Oshima et al. | |

FOREIGN PATENT DOCUMENTS

| | | |
|---|---|---|
| JP | 11-204850 | 7/1999 |
| JP | 2003-001824 | 1/2003 |

* cited by examiner

*Primary Examiner*—Thinh H Nguyen
(74) *Attorney, Agent, or Firm*—Workman Nydegger

(57) ABSTRACT

A liquid jet apparatus includes a plurality of nozzles provided to a liquid jet head, an actuator provided corresponding to each of the nozzles, and drive unit that applies a drive pulse to the actuator, wherein the drive unit includes correction value storing unit that stores a drive pulse application timing correction value corresponding to the number of actuators to be driven, and drive pulse application timing correction unit that corrects the drive pulse application timing using the drive pulse application timing correction value corresponding to the number of actuators to be driven stored in the correction value storing unit.

6 Claims, 12 Drawing Sheets

| | |
|---|---|
| ADDRESS 1 | DELAY TIME PERIOD CORRESPONDING TO NUMBER OF DRIVEN ACTUATORS OF 1 |
| ADDRESS 2 | DELAY TIME PERIOD CORRESPONDING TO NUMBER OF DRIVEN ACTUATORS OF 2 |
| ADDRESS 3 | DELAY TIME PERIOD CORRESPONDING TO NUMBER OF DRIVEN ACTUATORS OF 3 |
| ADDRESS 4 | DELAY TIME PERIOD CORRESPONDING TO NUMBER OF DRIVEN ACTUATORS OF 4 |
| ⋮ | ⋮ |
| ADDRESS (N-3) | DELAY TIME PERIOD CORRESPONDING TO NUMBER OF DRIVEN ACTUATORS OF (N-3) |
| ADDRESS (N-2) | DELAY TIME PERIOD CORRESPONDING TO NUMBER OF DRIVEN ACTUATORS OF (N-2) |
| ADDRESS (N-1) | DELAY TIME PERIOD CORRESPONDING TO NUMBER OF DRIVEN ACTUATORS OF (N-1) |
| ADDRESS (N) | DELAY TIME PERIOD CORRESPONDING TO NUMBER OF DRIVEN ACTUATORS OF (N) |

FIG.14

LIQUID JET APPARATUS, PRINTING APPARATUS, AND METHOD OF ADJUSTING PHASE OF DRIVE PULSE

BACKGROUND

1. Technical Field

The present invention relates to a liquid jet apparatus and printing apparatus arranged to print predetermined letters and images by emitting microscopic droplets of liquids from a plurality of nozzles to form the microscopic particles (dots) thereof on a printing medium.

2. Related Art

An inkjet printer as one of such printing apparatuses, which is generally low-price and easily provides high quality color prints, has widely been spreading not only to offices but also to general users along with the widespread of personal computers or digital cameras.

Further, in recent inkjet printers, printing in fine tone is required. Tone denotes a state of density of each color included in a pixel expressed by a liquid dot, the size of the liquid dot corresponding to the color density of each pixel is called a tone grade, and the number of the tone grades is called a tone number. The fine tone denotes that the tone number is large. In order for changing the tone grade, it is required to modify a drive pulse to an actuator provided to a liquid jet head. In the case in which a piezoelectric element is used as the actuator, since an amount of displacement (distortion) of the piezoelectric element (a diaphragm, to be precise) becomes large while a voltage value applied to the piezoelectric element becomes large, the tone grade of the liquid dot can be changed using this phenomenon.

Therefore, in JP-A-2003-1824, it is arranged that a plurality of drive pulses with different wave heights is combined and joined, the drive pulses are commonly output to the piezoelectric elements of the nozzles of the same color provided to the liquid jet head, a drive pulse corresponding to the tone grade of the liquid dot to be formed is selected for every nozzle out of the plurality of drive pulses, the selected drive pulses are supplied to the piezoelectric elements of the corresponding nozzles to emit droplets of the liquid different in weight, thereby achieving the required tone grade of the liquid dot.

However, in the past inkjet printer, there is a problem that the phase of the drive pulse is delayed by the parasitic inductance, the parasitic capacitance, and the resistance of the wiring of the drive circuit, and the capacitance of the actuator such as a piezoelectric element, and moreover, the amount of phase delay varies in accordance with the number of the actuators such as the piezoelectric elements driven by the drive pulse. The phase delay in the drive pulse causes delay in the liquid jet emission timing, resulting in variation in the liquid dot forming position (also referred to as a landing position) which leads degradation of the print quality.

Further, although it has been proposed to use a so-called class-D amplifier, which is a digital power amplifier with little heat generation and power loss, for power amplification of the drive pulses, since the phase characteristic of the low-pass filter varies in accordance with the number of the actuators to be driven, and the phase delay increases in accordance with increase in the number of the actuators to be driven, the phase delay described above becomes more apparent.

SUMMARY

The present invention has an object of providing a liquid jet apparatus, a printing apparatus, and a method of adjusting a phase a drive pulse for compensating the phase delay of the drive pulse to make the liquid jet emission timing proper.

A liquid jet apparatus according to an aspect of the invention is a liquid jet apparatus includes a plurality of nozzles provided to a liquid jet head, an actuator provided corresponding to each of the nozzles, and drive unit that applies a drive pulse to the actuator, wherein the drive unit includes correction value storing unit that stores a drive pulse application timing correction value corresponding to the number of actuators to be driven, and drive pulse application timing correction unit that corrects the drive pulse application timing using the drive pulse application timing correction value corresponding to the number of actuators to be driven stored in the correction value storing unit.

Further, it is preferable that the drive pulse application timing correction unit corrects drive pulse generation timing using the drive pulse application timing correction value corresponding to the number of the actuators to be driven.

Further, the printing apparatus of the invention is preferably a printing apparatus provided with the liquid jet apparatus described above.

Further, a method of adjusting a phase of a drive pulse of a liquid jet apparatus according to the present invention is a method of adjusting a phase of a drive pulse of a liquid jet apparatus including a plurality of nozzles provided to a liquid jet head, an actuator provided corresponding to each of the nozzles, and drive unit that applies a drive pulse to the actuator, the method of adjusting the phase of the drive pulse of a liquid jet apparatus including the step of storing a drive pulse application timing correction value corresponding to the number of actuators to be driven, and the step of correcting the drive pulse application timing using the drive pulse application timing correction value corresponding to the number of actuators to be driven.

Still further, it is preferable that in the step of correcting the drive pulse application timing, the drive pulse generation timing is corrected using the drive pulse application timing correction value corresponding to the number of the actuators to be driven.

According to the liquid jet apparatus, the printing apparatus, and the method of adjusting a phase of a drive pulse according to the present invention, the configuration of the drive circuit can be simplified, and the phase delay of a drive pulse can be compensated to make the liquid jet emission timing appropriate.

BRIEF DESCRIPTION OF THE DRAWINGS

FIG. 1 shows schematic configuration views showing an embodiment of a line head printing apparatus applying the liquid jet apparatus according to the present invention, wherein

FIG. 12 is a block diagram showing an output circuit for a clock signal shown in FIG. 3 and so on.

FIG. 14 is an explanatory diagram of drive pulse application timing correction values corresponding to the number of actuators to be driven stored in the delay time memory shown in FIG. 12.

DESCRIPTION OF EXEMPLARY EMBODIMENTS

An embodiment will be explained with reference to the drawings using a printing apparatus for printing letters and images on a print medium by emitting a liquid, as an example of the present invention.

Figure 1A:
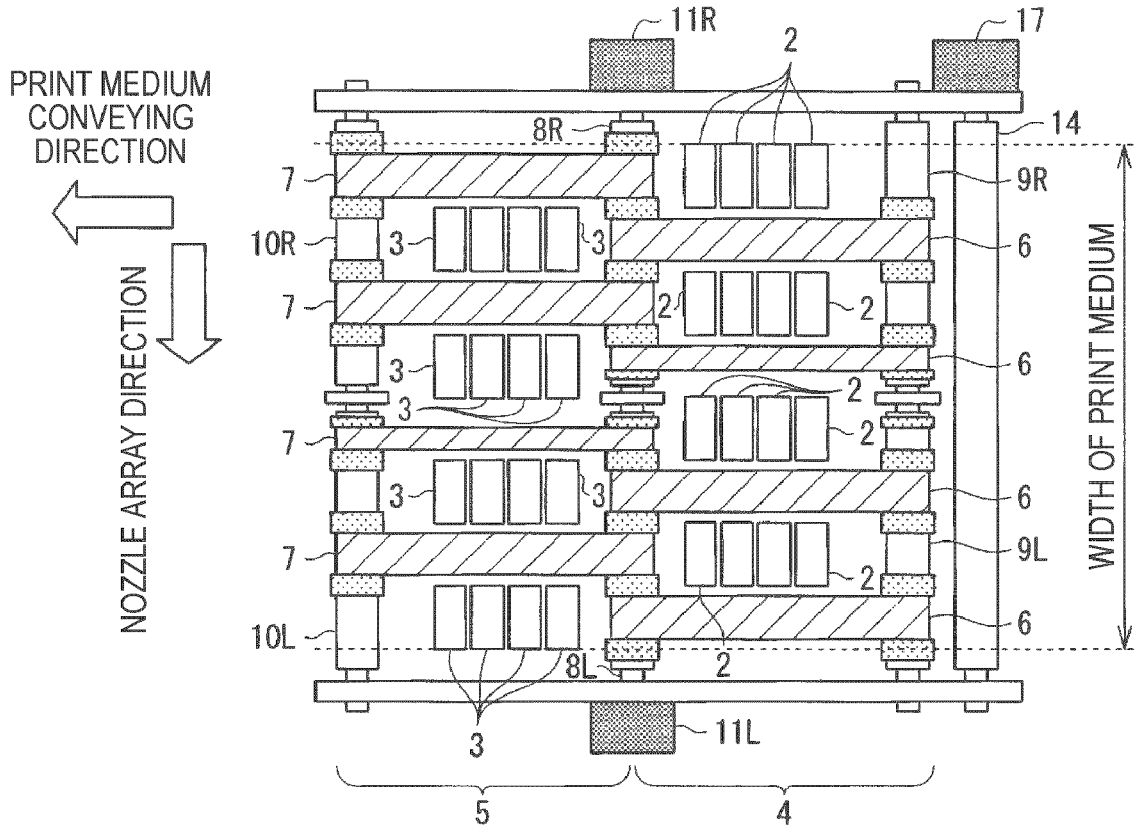
FIG. 1A is a plan view thereof.
Figure 1B:
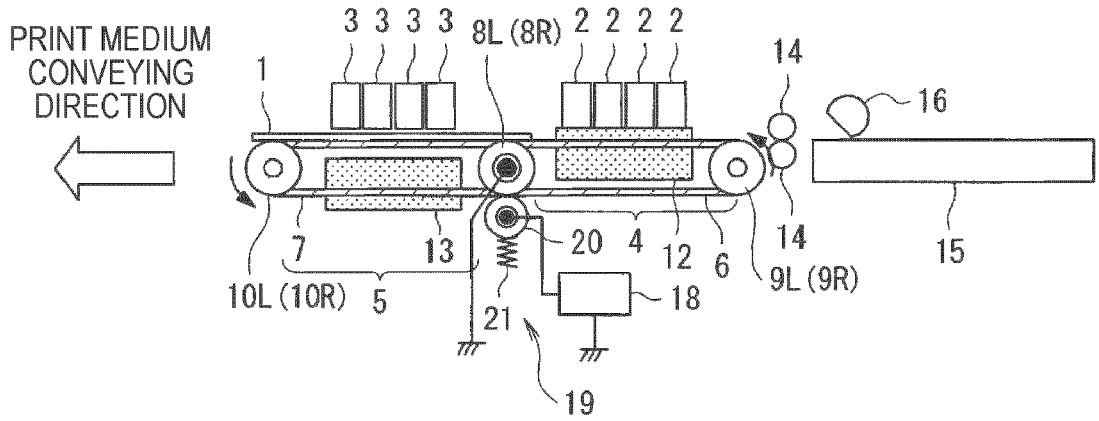
FIG. 1B is a front view thereof.

FIGS. 1A and 1B are schematic configuration views of the printing apparatus according to the present embodiment, wherein FIG. 1A is a plan view thereof, and FIG. 1B is a front view thereof. In FIG. 1, in the line head printing apparatus, a print medium 1 is conveyed from right to left of the drawing along the arrow direction, and is printed in a print area in the middle of the conveying path. It should be noted that the liquid jet head of the present embodiment is not disposed integrally in one place, but is disposed separately in two places.

The reference numeral 2 in the drawing denotes a first liquid jet head disposed on the upstream side in the conveying direction of the print medium 1, the reference numeral 3 denotes a second liquid jet head disposed downstream side in the conveying direction thereof, a first conveying section 4 for conveying the print medium 1 is disposed below the first liquid jet head 2, and a second conveying section 5 is disposed below the second liquid jet head 3. The first conveying section 4 is composed of four first conveying belts 6 disposed with predetermined intervals in the direction (hereinafter also referred to as a nozzle array direction) traversing the conveying direction of the print medium 1, the second conveying section 5 is similarly composed of four second conveying belts 7 disposed with predetermined intervals in the direction (the nozzle array direction) traversing the conveying direction of the print medium 1.

The four first conveying belts 6 and the similar four second conveying belts 7 are disposed alternately adjacent to each other. In the present embodiment, out of the conveying belts 6, 7, the two first and second conveying belts 6, 7 in the right side in the nozzle array direction are distinguished form the two first and second conveying belts 6, 7 in the left side in the nozzle array direction. In other words, an overlapping portion of the two of the first and second conveying belts 6, 7 in the right side in the nozzle array direction is provided with a right side drive roller 8R, an overlapping portion of the two of the first and second conveying belts 6, 7 in the left side in the nozzle array direction is provided with a left side drive roller 8L, a right side first driven roller 9R and left side first driven roller 9L are disposed on the upstream side thereof, and a right side second driven roller 10R and left side second driven roller 10L are disposed on the downstream side thereof. Although these rollers may seem a series of rollers, actually they are decoupled at the center portion of FIG. 1A.

Further, the two first conveying belts 6 in the right side in the nozzle array direction is wound around the right side drive roller 8R and the right side first driven roller 9R, the two first conveying belts 6 in the left side in the nozzle array direction is wound around the left side drive roller 8L and the left side first driven roller 9L, the two second conveying belts 7 in the right side in the nozzle array direction is wound around the right side drive roller 8R and the right side second driven roller 10R, the two second conveying belts 7 in the left side in the nozzle array direction is wound around the left side drive roller 8L and the left side second driven roller 10L, and further, a right side electric motor 11R is connected to the right side drive roller 8R, and a left side electric motor 11L is connected to the left side drive roller 8L. Therefore, when the right side electric motor 11R rotationally drives the right side drive roller 8R, the first conveying section 4 composed of the two first conveying belts 6 in the right side in the nozzle array direction and similarly the second conveying section 5 composed of the two second conveying belts 7 in the right side in the nozzle array direction move in sync with each other and at the same speed, while the left side electric motor 11L rotationally drives the left side drive roller 8L, the first conveying section 4 composed of the two first conveying belts 6 in the left side in the nozzle array direction and similarly the second conveying section 5 composed of the two second conveying belts 7 in the left side in the nozzle array direction move in sync with each other and at the same speed.

It should be noted that by arranging the rotational speeds of the right side electric motor 11R and the left side electric motor 11L to be different from each other, the conveying speeds in the left and right in the nozzle direction can be set different from each other, specifically, by arranging the rotational speed of the right side electric motor 11R higher than the rotational speed of the left side electric motor 11L, the conveying speed in the right side in the nozzle array direction can be made higher than that in the left side, and by arranging the rotational speed of the left side electric motor 11L higher than the rotational speed of the right side electric motor 11R, the conveying speed in the left side in the nozzle array direction can be made higher than that in the right side.

The first liquid jet head 2 and the second liquid jet head 3 are disposed by a unit of colors, yellow (Y), magenta (M), cyan (C), and black (K) shifted in the conveying direction of the print medium 1. The liquid jet heads 2, 3 are supplied with liquids from liquid tanks of respective colors not shown via liquid supply tubes. Each of the liquid jet heads 2, 3 is provided with a plurality of nozzles formed in the direction (namely, the nozzle array direction) traversing the conveying direction of the print medium 1, and by emitting a necessary amount of the liquid jet from the respective nozzles simultaneously to the necessary positions, microscopic liquid dots are formed on the print medium 1. By performing the process described above by the unit of the colors, one-pass print can be achieved only by making the print medium 1 conveyed by the first and second conveying sections 4, 5 pass therethrough once. In other words, the area in which the liquid jet heads 2, 3 are disposed corresponds to the print area.

As a method of emitting liquid jets from each of the nozzles of the liquid jet heads, an electrostatic method, a piezoelectric method, and a film boiling jet method and so on can be cited. In the electrostatic method, when a drive signal is provided to an electrostatic gap as an actuator, a diaphragm in a cavity is displaced to cause pressure variation in the cavity, and the liquid jet is emitted from the nozzle in accordance with the pressure variation. In the piezoelectric method, when a drive signal is provided to a piezoelectric element as an actuator, a diaphragm in a cavity is displaced to cause pressure variation in the cavity, and the liquid jet is emitted from the nozzle in accordance with the pressure variation. In the film boiling jet method, a microscopic heater is provided in the cavity, and is instantaneously heated to be at a temperature of 300° C. or higher to make the liquid become the film boiling state to generate a bubble, thus causing the pressure variation making the liquid jet be emitted from the nozzle. The present invention can apply either liquid jet methods, and among others, the invention is particularly preferable for the piezoelectric element capable of adjusting an amount of the liquid jet by controlling the wave height or gradient of increase or decrease in the voltage of the drive signal.

The liquid jet emission nozzles of the first liquid jet head 2 are only provided between the four first conveying belts 6 of the first conveying section 4, the liquid jet emission nozzles of the second liquid jet head 3 are only provided between the four second conveying belts 7 of the second conveying section 5. Although this is for cleaning each of the liquid jet heads 2, 3 with a cleaning section described later, in this case, the entire surface is not printed by the one-pass printing if either one of the liquid jet heads is used. Therefore, the first liquid jet head 2 and the second liquid jet head 3 are disposed shifted in the conveying direction of the print head 1 in order for compensating for each other's unprintable areas.

What is disposed below the first liquid jet head 2 is a first cleaning cap 12 for cleaning the first liquid jet head 2, and what is disposed below the second liquid jet head 3 is a second cleaning cap 13 for cleaning the second liquid jet head 3. Each of the cleaning caps 12, 13 is formed to have a size allowing the cleaning caps to pass through between the four first conveying belts 6 of the first conveying section 4 and between the four second conveying belts 7 of the second conveying section 5. Each of the cleaning caps 12, 13 is composed of a cap body having a rectangular shape with a bottom, covering the nozzles provided to the lower surface, namely a nozzle surface of the liquid jet head 2, 3, and capable of adhering the nozzle surface, a liquid absorbing body disposed at the bottom, a peristaltic pump connected to the bottom of the cap body, and an elevating device for moving the cap body up and down. Then, the cap body is moved up by the elevating device to be adhered to the nozzle surface of the liquid jet head 2, 3. By causing the negative pressure in the cap body using the peristaltic pump in the present state, the liquid and bubbles are suctioned from the nozzles opened on the nozzle surface of the liquid jet head 2, 3, thus the cleaning of the liquid jet head 2, 3 can be performed. After the cleaning is completed, each of the cleaning caps 12, 13 is moved down.

On the upstream side of the first driven rollers 9R, 9L, there is provided a pair of gate rollers 14 for adjusting the feed timing of the print medium 1 from a feeder section 15 and at the same time correcting the skew of the print medium 1. The skew denotes a turn of the print medium 1 with respect to the conveying direction. Further, above the feeder section 15, there is provided a pickup roller 16 for feeding the print medium 1. It should be noted that the reference numeral 17 in the drawing denotes a gate roller motor for driving the gate rollers 14.

A belt charging device 19 is disposed below the drive rollers 8R, 8L. The belt charging device 19 is composed of a charging roller 20 having a contact with the first conveying belts 6 and the second conveying belts 7 via the drive rollers 8R, 8L, a spring 21 for pressing the charging roller 20 against the first conveying belts 6 and the second conveying belts 7, and a power supply 18 for providing charge to the charging roller 20, and charges the first conveying belts 6 and the second conveying belts 7 by providing them with the charge from the charging roller 20. Since the belts are generally made of a moderate or high resistivity material or an insulating material, when they are charged by the belt charging device 19, the charge applied on the surface thereof causes the print medium 1 made similarly of a high resistivity material or an insulating material the dielectric polarization, and the print medium 1 can be absorbed to the belt by the electrostatic force caused between the charge generated by the dielectric polarization and the charge on the surface of the belt. It should be noted that as the belt charging unit, a corotron for showering the charges can also be used.

Therefore, according to the present printing apparatus, when the surfaces of the first conveying belts 6 and the second conveying belts 7 are charged by the belt charging device 19, the print medium 1 is fed from the gate roller 14 in that state, and the print medium 1 is pressed against the first conveying belts 6 by a sheet pressing roller composed of a spur or a roller not shown, the print medium 1 is absorbed by the surfaces of the first conveying belts 6 under the action of dielectric polarization. In this state, when the electric motors 11R, 11L rotationally drive the drive rollers 8R, 8L, the rotational drive force is transmitted to the first driven rollers 9R, 9L via the first conveying belts 6.

Thus, the first conveying belts 6 are moved to the downstream side of the conveying direction while absorbing the print medium 1, printing is performed by emitting liquid jets from the nozzles formed on the first liquid jet head 2 while moving the print medium 1 to below the first liquid jet head 2. When the printing by the first liquid jet head 2 is completed, the print medium 1 is moved downstream side of the conveying direction to be switched to the second conveying belts 7 of the second conveying section 5. As described above, since the second conveying belts 7 are also provided with the charge on the surface thereof by the belt charging device 19, the print medium 1 is absorbed by the surfaces of the second conveying belts 7 under the action of the dielectric polarization.

In the present state, the second conveying belts 7 are moved to the downstream side of the conveying direction, printing is performed by emitting liquid jets from the nozzles formed on the second liquid jet head 3 while moving the print medium 1 to below the second liquid jet head 3. After the printing by the second liquid jet head is completed, the print medium 1 is moved further to the downstream side of the conveying direction, the print medium 1 is ejected to a catch tray while separating it from the surfaces of the second conveying belts 7 by a separating device not shown in the drawings.

Further, when the cleaning of the first and second liquid ejection heads 2, 3 becomes necessary, as described above, the first and second cleaning caps 12, 13 are raised to be adhered to the nozzle surfaces of the first and second liquid jet heads 2, 3, the cleaning is performed by applying negative pressure to the inside of the caps at that state to suction liquid and bubbles from the nozzles of the first and second liquid jet heads 2, 3, and after then, the first and second cleaning caps 12, 13 are moved down.

Figure 2:
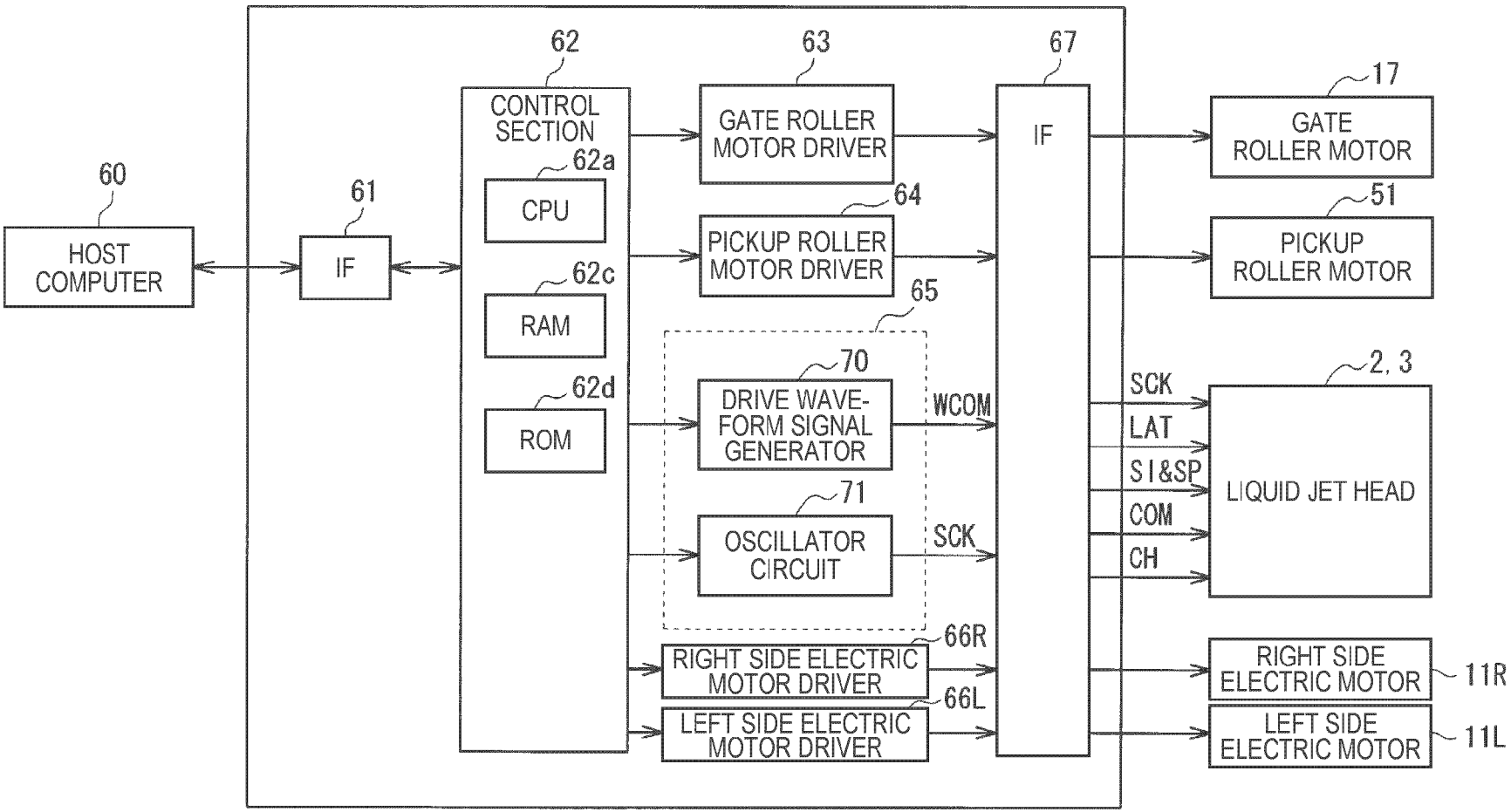
FIG. 2 is a block diagram of a control device of the printing apparatus shown in FIG. 1.

Inside the printing apparatus, there is provided a control device for controlling the device itself. The control device is, as shown in FIG. 2, for controlling the printing apparatus, the feeder device, and so on based on print data input from a host computer 60 such as a personal computer or a digital camera, thereby performing the print process on the print medium. Further, the control device is configured including an input interface section 61 for receiving print data input from the host computer 60, a control section 62 formed of a microcomputer for performing the print process based on the print data input from the input interface section 61, a gate roller motor driver 63 for controlling driving the gate roller motor 17, a pickup roller motor driver 64 for controlling driving a pickup roller motor 51 for driving the pickup roller 16, a head driver 65 for controlling driving the liquid jet heads 2, 3, a right side electric motor driver 66R for controlling driving the right side electric motor 11R, a left side electric motor driver 66L for controlling driving the left side electric motor 11L, and an interface 67 for converting the output signals of the drivers 63 through 65, 66R, 66L into control signals used in the gate roller motor 17, the pickup roller motor 51, the liquid jet heads 2, 3, the right side electric motor 11R, and the left side electric motor 11L outside thereof.

The control section 62 is provided with a central processing unit (CPU) 62*a* for performing a various processes such as the print process, a random access memory (RAM) 62*c* for temporarily stores the print data input via the input interface 61 and various kinds of data used in performing the print process of the print data, and for temporarily developing an application program such as for the print process, and a read-only memory (ROM) 62*d* formed of a nonvolatile semiconductor memory and for storing the control program executed by the CPU 62*a* and so on. When the control section 62 receives the print data (image data) from the host computer 60 via the interface section 61, the CPU 62*a* performs a predetermined process on the print data to output printing data (drive pulse selection data SI&SP) regarding which nozzle emits the liquid jet or how much liquid jet is emitted, and further outputs the control signals to the respective drivers 63 through 65, 66R, and 66L based on the printing data and the input data from the various sensors. When the control signals are output from the respective drivers 63 through 65, 66R, and 66L, the control signals are converted by the interface section 67 into the drive signals, the actuators corresponding to a plurality of nozzles of the liquid jet heads, the gate roller motor 17, the pickup roller motor 51, the right side electric motor 11R, and the left side electric motor 11L respectively operate, thus the feeding and conveying the print medium 1, posture control of the print medium 1, and the print process to the print medium 1 are performed. It should be noted that the elements inside the control section 62 are electrically connected to each other via a bus not shown in the drawings.

Further, in order for writing the waveform forming data DATA for forming the drive signal described later in a waveform memory 701, the control section 62 outputs a write enable signal DEN, a write clock signal WCLK, and write address data A0 through A3 to write the 16 bit waveform forming data DATA into the waveform memory 701, and further, outputs the read address data A0 through A3 for reading the waveform forming data DATA stored in the waveform memory 701, a first clock signal ACLK for setting the timing for latching the waveform forming data DATA retrieved from the waveform memory 701, a second clock signal BCLK for setting the timing for adding the latched waveform data, and a clear signal CLER for clearing the latched data to the head driver 65.

Figure 3:
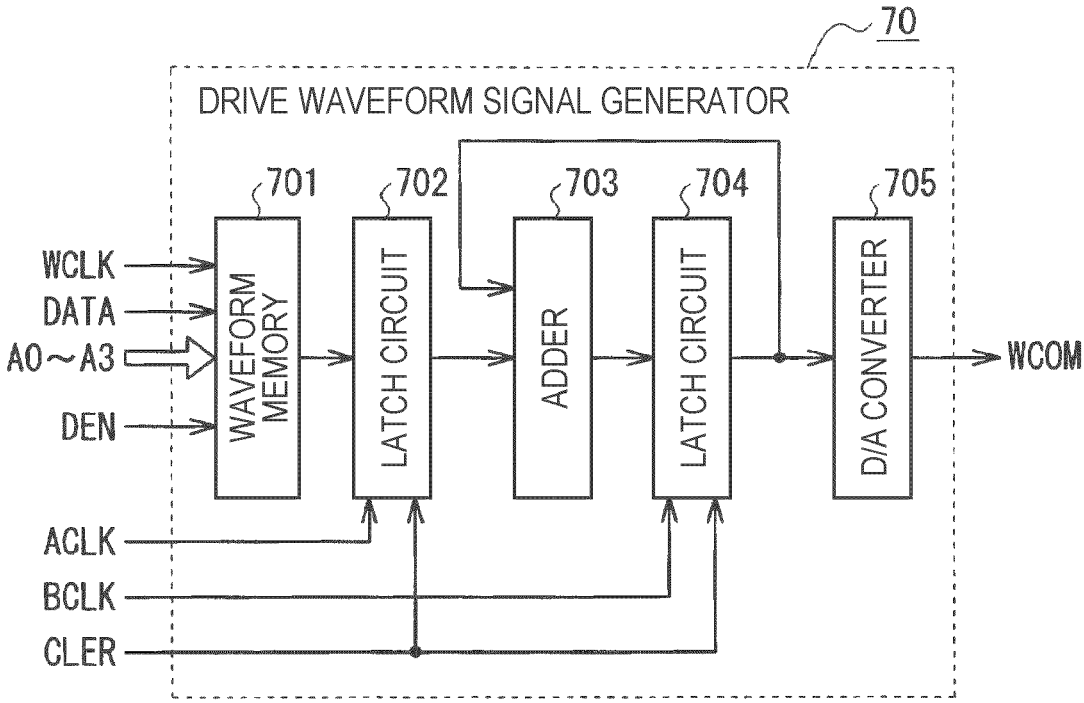
FIG. 3 is a block configuration diagram of the drive waveform signal generation circuit shown in FIG. 2.

The head driver 65 is provided with a drive waveform generator 70 for forming drive waveform signal WCOM and an oscillator circuit 71 for outputting a clock signal SCK. The drive waveform generator 70 is provided, as shown in FIG. 3, with the waveform memory 701 for storing the waveform forming data DATA for forming the drive waveform signal and input from the control section 62 in the storage element corresponding to a predetermined address, a latch circuit 702 for latching the waveform forming data DATA retrieved from the waveform memory 701 in accordance with the first clock signal ACLK described above, an adder 703 for adding the output of the latch circuit 702 with the waveform generation data WDATA output from a latch circuit 704 described later, the latch circuit 704 for latching the added output of the adder 703 in accordance with the second clock signal BCLK, and a D/A converter 705 for converting the waveform generation data WDATA output from the latch circuit 704 into an analog signal. In this case, the clear signal CLER output from the control section 62 is input to the latch circuits 702, 704, and when the clear signal CLER is turned to be the off state, the latched data is cleared.

Figure 4:
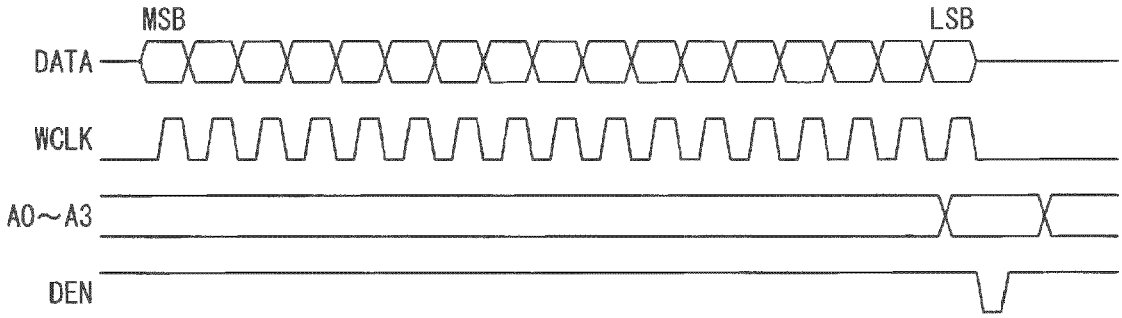
FIG. 4 is an explanatory diagram of the waveform memory shown in FIG. 3.

The waveform memory 701 is provided, as shown in FIG. 4, with a several bits of memory elements arranged in each designated address, and the waveform data DATA is stored together with the address A0 through A3. Specifically, the waveform data DATA is input in accordance with the clock signal WCLK with respect to the address A0 through A3 designated by the control section 62, and the waveform data DATA is stored in the memory elements in response to input of the write enable signal DEN.

Subsequently, the principle of generating the drive waveform signal by the drive waveform generator 70 will be explained. Firstly, in the address A0, there is written the waveform data of zero as an amount of voltage variation per unit time period. Similarly, the waveform data of +ΔV1 is written in the address A1, the waveform data of −ΔV2 is written in the address A2, and the waveform data of +ΔV3 is written in the address A3, respectively. Further, the stored data in the latch circuits 702, 704 is cleared by the clear signal CLER. Further, the drive waveform signal WCOM is raised to an intermediate voltage potential (offset) by the waveform data.

Figure 5:
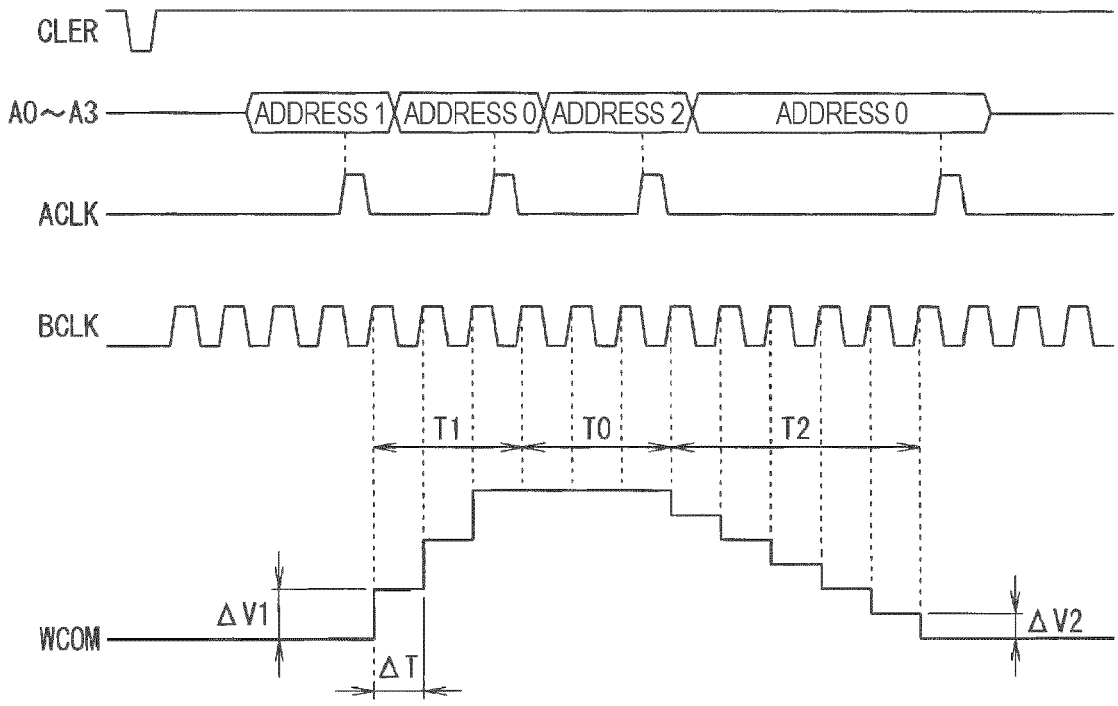
FIG. 5 is an explanatory diagram of generation of the drive waveform signal.

In the present state, when the waveform data in the address A1 is retrieved, as shown in FIG. 5 and the first clock signal ACLK is input, the digital data of +ΔV1 is stored in the latch circuit 702. The stored digital data of +ΔV1 is input to the latch circuit 704 via the adder 703, and in the latch circuit 704, the output of the adder 703 is stored in sync with the rising of the second clock BCLK. Since the output of the latch circuit 704 is also input to the adder 703, the output of the latch circuit 704, namely the drive waveform signal WCOM is added with +ΔV1 with every rising timing of the second clock BCLK. In the present example, the waveform data in the address of A1 is retrieved for a time interval of T1, and as a result, the digital data of +(V1 is added to be three times as large as +ΔV1.

Subsequently, when the waveform data in the address A0 is retrieved, and in addition, the first clock ACLK is input, the digital data stored in the latch circuit 702 is switched to zero. Although this digital data of zero is, similarly to the case described above, added through the adder 703 with the rising timing of the second clock signal BCLK, since the digital data is zero, the previous value is actually maintained. In the present example, the drive waveform signal WCOM is maintained at a constant value for the time period of T0.

Subsequently, when the waveform data in the address A2 is retrieved, and in addition, the first clock signal ACLK is input, the digital data stored in the latch circuit 702 is switched to −ΔV2. Although the digital data of −ΔV2 is, similarly to the case described above, added through the adder 703 with the rising timing of the second clock signal BCLK, since the digital data is −ΔV2, the drive waveform signal WCOM is actually subtracted by −ΔV2 in accordance with the second clock signal. In the present embodiment, the digital data is subtracted for the time period of T2 until the digital data becomes 6 times as large as −ΔV2.

Figure 6:
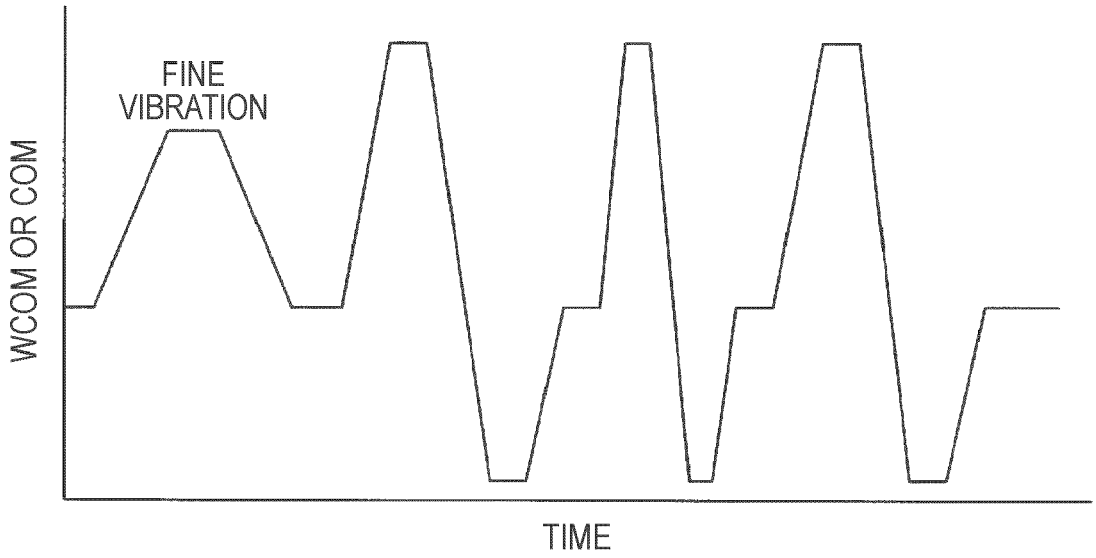
FIG. 6 is an explanatory diagram of the drive waveform signal or the drive signal connected in a time-series manner.
Figure 7:
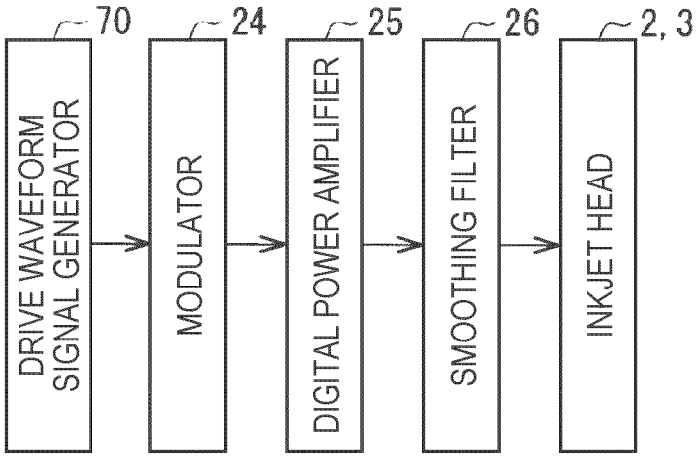
FIG. 7 is a block configuration diagram of a drive signal output circuit.

By performing the analog conversion by the D/A converter 705 on the digital signal thus generated, the drive waveform signal WCOM composed of a plurality of trapezoidal voltage waves as shown in FIG. 6 can be obtained. By performing the power amplification by the drive signal output circuit shown in FIG. 7 on the above signal, and supplying it to the liquid jet heads 2, 3 as the drive signal COM, it becomes possible to drive the actuator provided to each of the nozzles, thus the liquid jet can be emitted from each of the nozzles. The drive signal output circuit is configured including a modulator 24 for performing the pulse width modulation on the drive waveform signal WCOM generated by the drive waveform generator 70, a digital power amplifier 25 for performing the power amplification on the modulated (PWM) signal on which the pulse width modulation is performed by the modulator 24, and a low-pass filter 26 for smoothing the modulated (PWM) signal amplified by the digital power amplifier 25. The drive signal output circuit will be described in detail in the latter part.

The rising portion of the drive signal COM corresponds to the stage of expanding the capacity of the cavity (pressure chamber) communicating the nozzle to pull in the liquid (it can be said that the meniscus is pulled in considering the emission surface of the liquid), and the falling portion of the drive signal COM corresponding to the stage of reducing the capacity of the cavity to push out the liquid (it can be said that the meniscus is pushed out considering the emission surface of the liquid), as the result of pushing out the liquid, the liquid jet is emitted from the nozzle. The series of waveform signals from pulling in the liquid to pushing out the liquid according to needs are assumed to form the drive pulse, and the drive signal COM is assumed to be formed by linking a plurality of drive pulses. Incidentally, the waveform of the drive signal COM or of the drive waveform signal WCOM can be, as easily inferred from the above description, adjusted by the waveform data 0, +ΔV1, −ΔV2, and +ΔV3 stored in the addresses A0 through A3, the first clock signal ACLK, the second clock signal BCLK. Further, although the first clock signal ACLK is called a clock signal for the sake of convenience, actually, the output timing of the signal can freely be adjusted by an arithmetic process described later.

By variously changing the gradient of increase and decrease in voltage and the height of the drive pulse formed of this trapezoidal voltage wave, the pull-in amount and the pull-in speed of the liquid, and the push-out amount and the push-out speed of the liquid can be changed, thus the amount of liquid jet can be changed to obtain a different size of the liquid dot. Therefore, as shown in FIG. 6, in the case in which a plurality of drive pulses are sequentially joined to form the drive signal COM, it is possible that the single drive pulse is selected from such drive pulses to supply the actuator to emit the liquid jet, or a plurality of drive pulses is selected and supplied to the actuator to emit the liquid jet a number of times, thus the liquid dots with various sizes can be obtained. In other words, when a number of liquid droplets land on the same position while the liquid is not dried, it brings substantially the same result as emitting a larger droplet of the liquid, thus the size of the liquid dot can be enlarged. By combination of such technologies, the fine tone printing can be achieved. It should be noted that the drive pulse shown in the left end of FIG. 6 is only for pulling in the liquid without pushing out the liquid. This is called a fine vibration, and is used for preventing the nozzle from drying without emitting the liquid jet.

As a result of the above, the liquid jet heads 2, 3 are provided with the drive signal COM generated by the drive signal output circuit, the drive pulse selection data SI&SP for selecting the nozzle emitting the liquid jet and determining the connection timing of the actuator to the drive signal COM based on the print data, the latch signal LAT and a channel signal CH for connecting the drive signal COM and the actuator of the liquid jet heads 2, 3 to apply the drive pulse to the actuator based on the drive pulse selection data SI&SP after the nozzle selection data is input to all of the nozzles, and the clock signal SCK for transmitting the drive pulse selection data SI&SP to the liquid jet heads 2, 3 as a serial signal input thereto.

Figure 8:
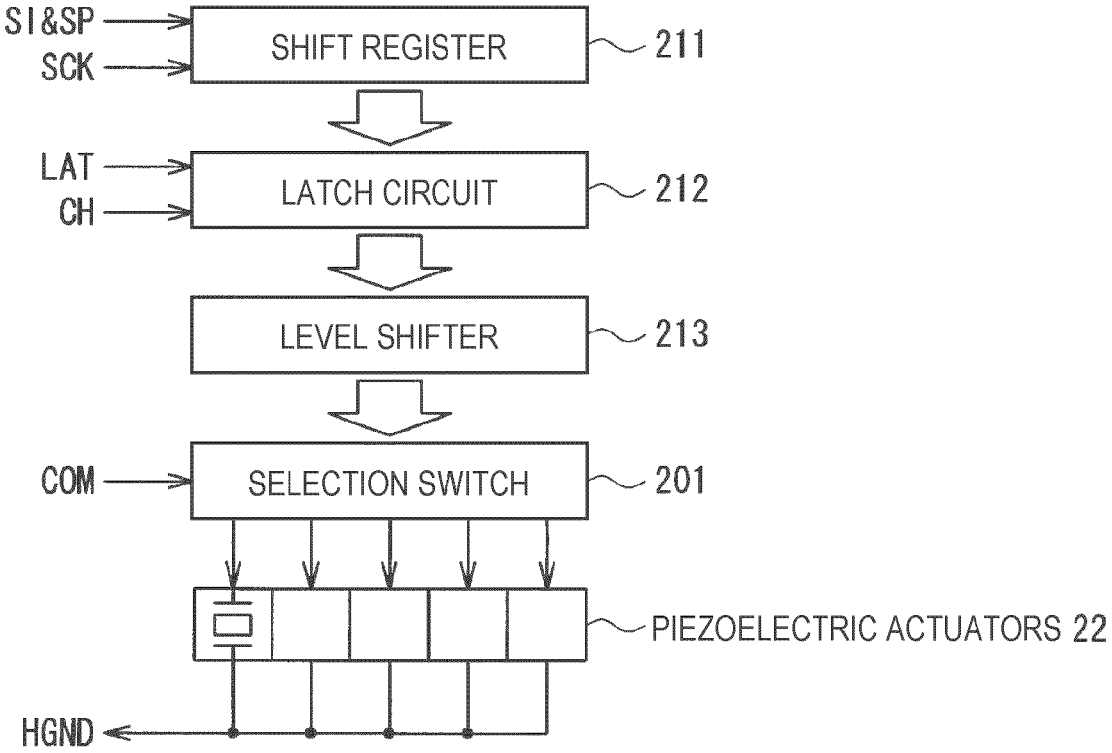
FIG. 8 is a block diagram of a selection section for connecting the drive signal to an actuator.

Subsequently, the configuration of connecting the drive signals COM output from the drive signal output circuit to the actuator will be explained. FIG. 8 is a block diagram of the selection section for connecting the drive signals COM to the piezoelectric actuators 22 such as the piezoelectric element. The selection section is composed of a shift register 211 for storing the drive pulse selection data SI&SP for designating the piezoelectric actuator 22 such as a piezoelectric element corresponding to the nozzle from which the liquid jet is to be emitted, a latch circuit 212 for temporarily storing the data of the shift register 211, a level shifter 213 for performing level conversion on the output of the latch circuit 212, and a selection switch 201 for connecting the drive signal COM to the piezoelectric actuator 22 such as a piezoelectric element in accordance with the output of the level shifter.

The drive pulse selection data SI&SP is sequentially input to the shift register 211, and at the same time, the storage area is sequentially shifted from the first stage to the subsequent stage in accordance with the input pulse of the clock signal SCK. The latch circuit 212 latches the output signals of the shift register 211 in accordance with the input latch signal LAT after the drive pulse selection data SI&SP corresponding to the number of the nozzles is stored in the register 211. The signals stored in the latch circuit 212 are converted into the voltage level capable of switching on and off the selection switch 201 on the subsequent stage by the level shifter 213. This is because the drive signal COM has a high voltage compared to the output voltage of the latch circuit 212, and the operating voltage range of the selection switch 210 is also set higher accordingly. Therefore, the piezoelectric actuator 22 such as piezoelectric element the selection switch 201 of which is closed by the level shifter 213 is connected to the drive signal COM with the connection timing of the drive pulse selection data SI&SP. Further, after the drive pulse selection data SI&SP of the shift register 211 is stored in the latch circuit 212, the subsequent drive pulse data SI&SP is input to the shift register 211, and the stored data of the latch circuit 212 is sequentially updated with the liquid jet emission timing. It should be noted that the reference HGND in the drawings denotes the ground terminal for the piezoelectric actuator 22 such as the piezoelectric element. Further, according to the selection switch 201, even after the piezoelectric actuator 22 such as the piezoelectric element is separated from the drive signal COM, the input voltage of the piezoelectric actuator 22 is maintained at the voltage immediately before it is separated.

Figure 9:
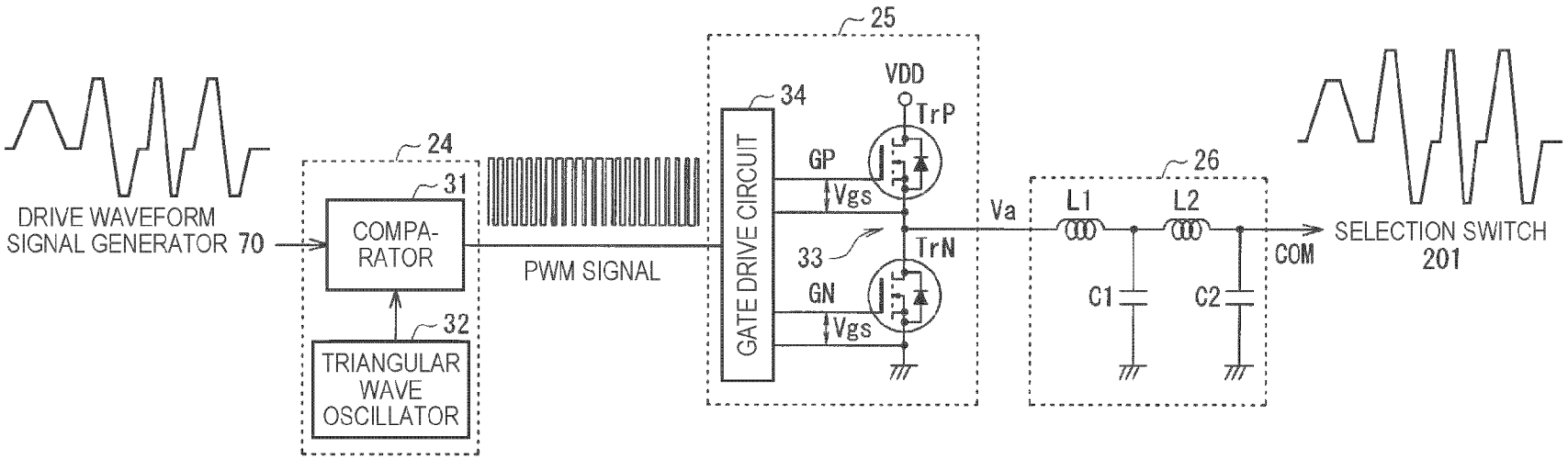
FIG. 9 is a block diagram showing details of the modulation circuit, the digital power amplifier, and the low-pass filter of the drive signal output circuit shown in FIG. 7.
Figure 10:
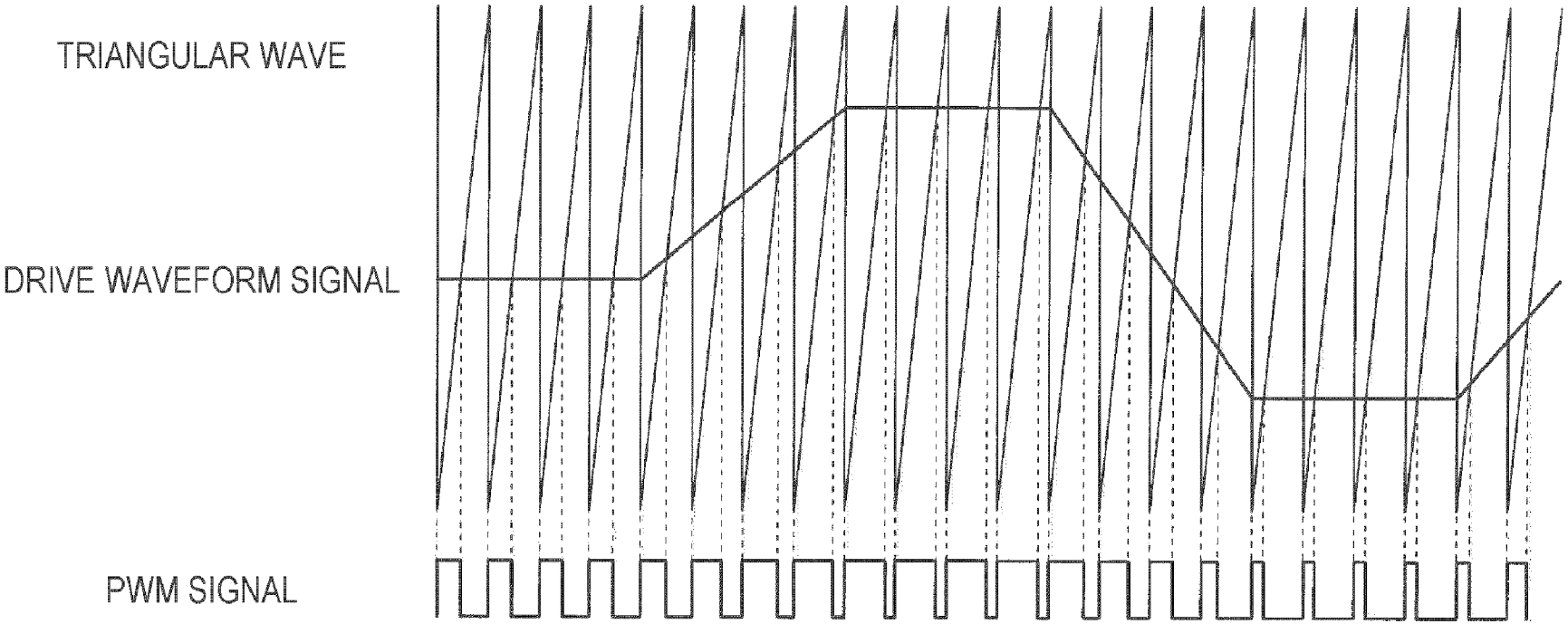
FIG. 10 is an explanatory diagram of the operation of the modulation circuit shown in FIG. 9.

FIG. 9 shows a specific configuration from the modulator 24 of the drive signal output circuit described above to the low-pass filter 26. As the modulator 24 for performing the pulse width modulating on the drive waveform signal WCOM, a common pulse width modulation (PWM) circuit is used. The modulator 24 is composed of a well-known triangular wave oscillator 32, and a comparator 31 for comparing the triangular wave output from the triangular wave oscillator 32 with the drive waveform signal WCOM. According to the modulator 24, as shown in FIG. 10, the modulated (PWM) signal, which is set to HIGH level when the drive waveform signal WCOM exceeds the triangular wave, and is set to LOW level when the drive waveform signal WCOM is lower than the triangular wave, is output. It should be noted that although in the present embodiment the pulse width modulation circuit is used as the pulse modulator, a pulse density modulation (PDM) circuit can also be used instead.

Figure 11:
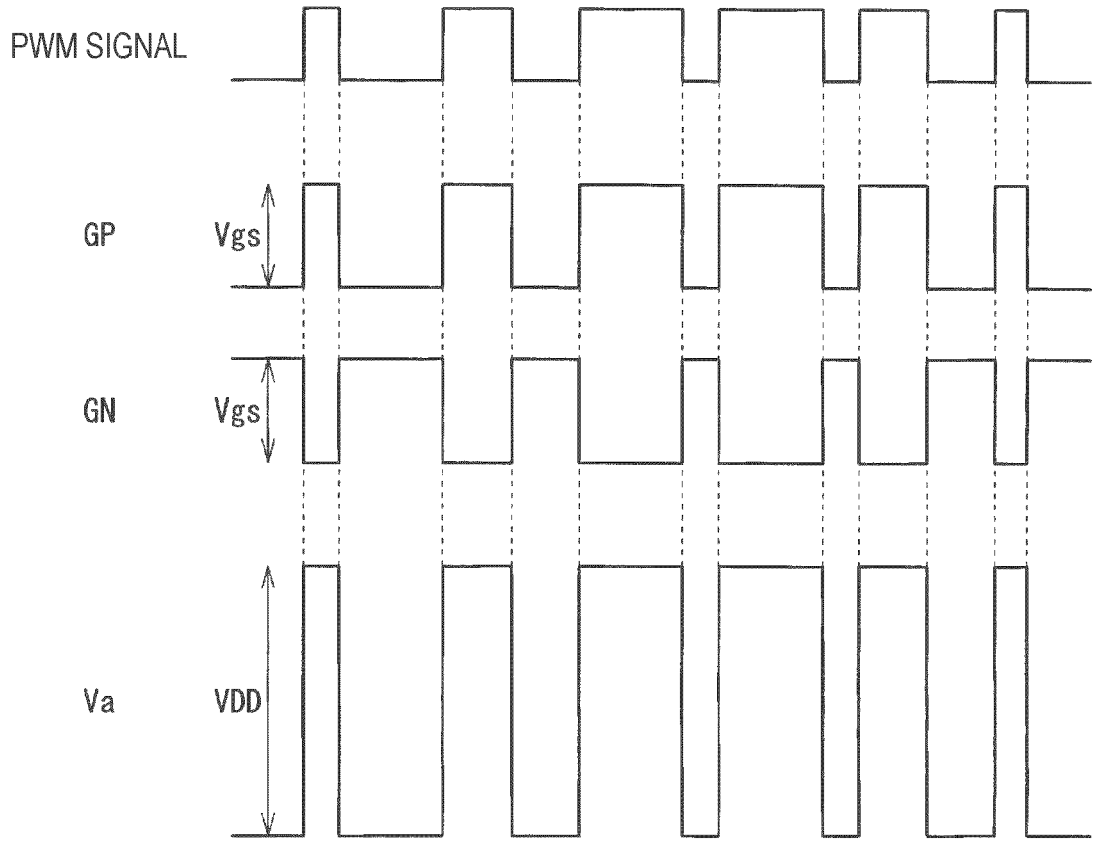
FIG. 11 is an explanatory diagram of the operation of the digital power amplifier shown in FIG. 9.

The digital power amplifier 25 is configured including a half-bridge driver stage 33 composed of two MOSFET TrP, TrN for substantially amplifying the power, and a gate drive circuit 34 for controlling the gate-source signals GP, GN of the MOSFET TrP, TrN based on the modulated (PWM) signal from the modulator 24, and the half-bridge driver stage 33 is formed by combining the high-side MOSFET TrP and the low-side MOSFET TrN in a push-pull manner. Assuming that the gate-source signal of the high-side MOSFET TrP is GP, the gate-source signal of the low-side MOSFET TrN is GN, and the output of the half-bridge driver stage 33 is Va, FIG. 11 shows how these signals varies in accordance with the modulated (PWM) signal. It should be noted that the voltage values Vgs of the gate-source signals GP, GN of the respective MOSFET TrP, TrN are assumed to be sufficient to turn the MOSFET TrP, TrN.

When the modulated (PWM) signal is in the HIGH level, the gate-source signal GP of the high-side MOSFET TrP becomes in the HIGH level while the gate-source signal GN of the low-side MOSFET TrN becomes in the LOW level, the high-side MOSFET TrP becomes the ON state while the low-side MOSFET TrN becomes the OFF state, and as a result, the output Va of the half-bridge driver state 33 becomes in the supply voltage VDD. On the other hand, when the modulated (PWM) signal is in the LOW level, the gate-source signal GP of the high-side MOSFET TrP becomes in the LOW level while the gate-source signal GN of the low-side MOSFET TrN becomes in the HIGH level, the high-side MOSFET TrP becomes the OFF state while the low-side MOSFET TrN becomes the ON state, and as a result, the output Va of the half-bridge driver state 33 becomes zero.

The output Va of the half-bridge driver stage 33 of the digital power amplifier 25 is supplied to the selection switch 201 as the drive signal COM via the low-pass filter 26. The low-pass filter 26 is formed of a low-pass filter composed of a combination of two coils L1, L2, and two capacitors C1, C2. The low-pass filter 26 formed of the low pass filter is designed to sufficiently attenuate the high frequency component of the output Va of the half-bridge driver stage 33 of the digital power amplifier 25, namely the power amplified modulated (PWM) signal component, and at the same time, not to attenuate the drive signal component COM (or alternatively, the drive waveform component WCOM).

As described above, when the MOSFET TrP, TrN of the digital power amplifier 25 are driven in a digital manner, since the MOSFET acts as a switch element, although the current flows in the MOSFET in the ON state, the drain-source resistance is extremely small, and the power loss is hardly caused. Further, since no current flows in the MOSFET in the OFF state, the power loss does not occur. Therefore, the power loss of the digital power amplifier 25 is extremely small, the small-sized MOSFET can be used, and the cooling unit such as a heat radiation plate for cooling can be eliminated. Incidentally, the efficiency in the case in which the transistor is driven in the linear range is about 30% while the efficiency of digital power amplifier is 90% or higher. Further, since the heat radiation plate for cooling the transistor requires about 60 mm square in size for each transistor, if such a radiation plate can be eliminated, an overwhelming advantage in the actual layout can be obtained.

Figure 12:
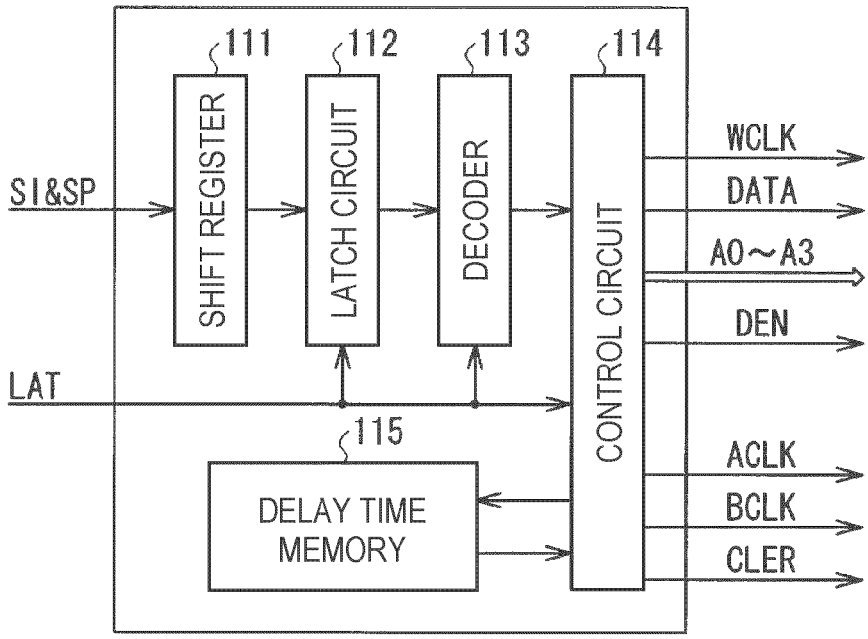

Subsequently, FIG. 12 shows an output circuit for the waveform forming data DATA output towards the drive waveform generator 70, the write enable signal DEN, the write clock signal WCLK, the write address data A0 through A3, the first clock signal ACLK, the second clock signal BCLK, and the clear signal CLER. The output circuit is actually configured in the control section 62 by software, and is shown in the form of a block diagram with blocks of respective functions. The output circuit is provided with a shift register 111 for sequentially storing the drive pulse selection data SI&SP for designating the actuator corresponding to the nozzle from which the liquid jet is emitted, a latch circuit 112 for temporarily storing the data of the shift register 111 in response to the latch signal LAT, a decoder 113 for decoding the data of the latch circuit 112 in response to the latch signal LAT, a control circuit 114 for outputting the waveform forming data DATA, the write enable signal DEN, the write clock signal WCLK, the write address data A0 through A3, the first clock signal ACLK, the second clock signal BCLK, and the clear signal CLER in accordance with the data decoded in the decoder 113 and the latch signal LAT by performing the arithmetic processing described later and shown in FIG. 15, and a delay time memory 115 for storing delay time periods corresponding to the number of actuators to be driven.

Subsequently, the delay time periods corresponding to the number of actuators to be driven stored in the delay time memory 115 will be explained. Since the actuator has a capacitance, when the number of nozzles for emitting the liquid jet, namely the number of actuators to be driven varies, the characteristic of a low-pass filter by the low-pass filter and the capacitances of the actuators is varied. Every time the actuator is connected to the low-pass filter, the capacitance is connected in parallel one after another, thus the characteristic of the low-pass filter by the low-pass filter and the capacitances of the actuators should be varied.

Figure 13:
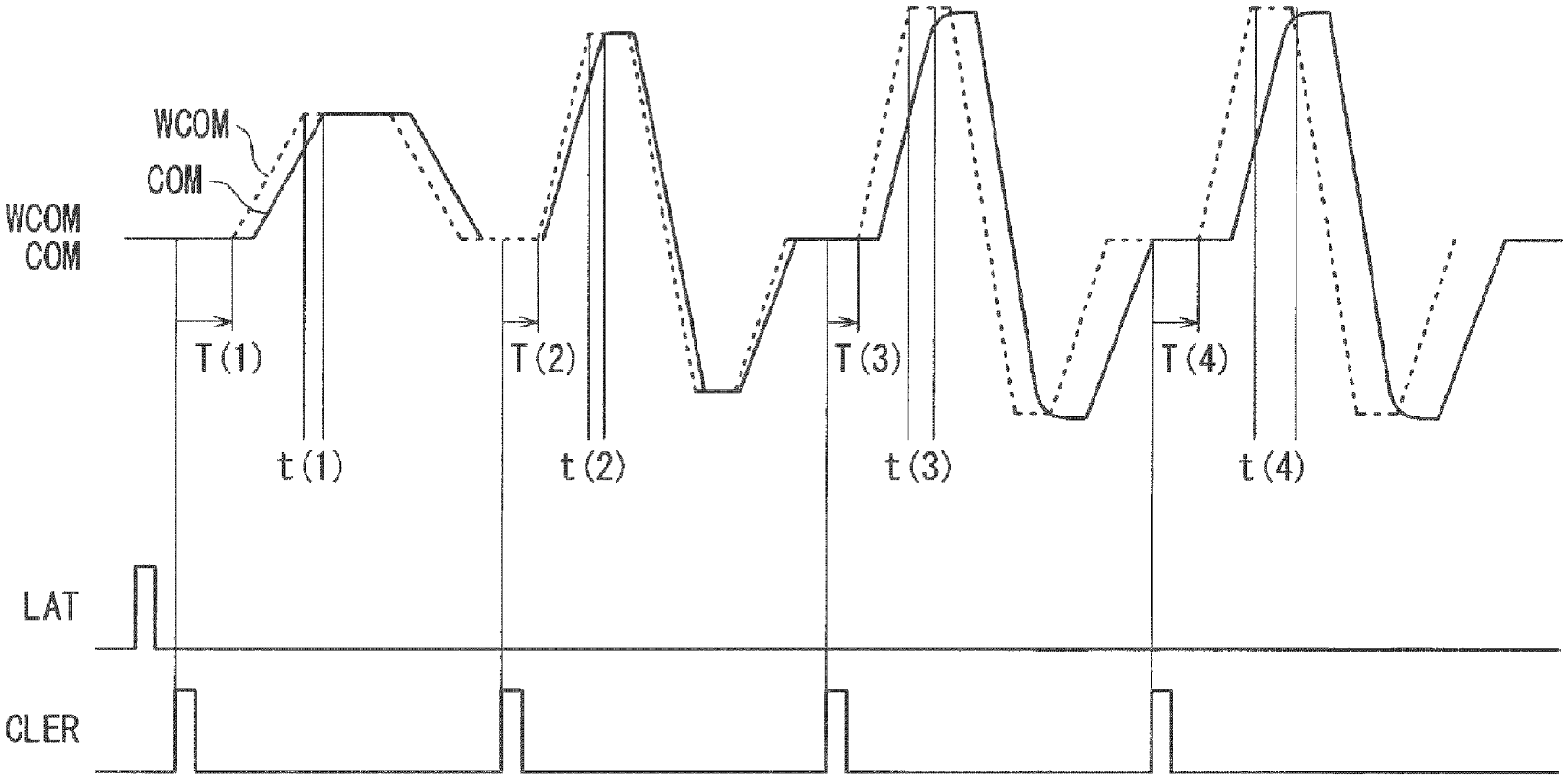
FIG. 13 is an explanatory diagram showing the delay in the drive pulse with respect to the drive waveform signal.

FIG. 13 shows the condition in which the phase delay illustrated with the solid line is caused in the drive signal COM, namely the drive pulses with respect to the original drive waveform signal WCOM illustrated with the broken line by the low-pass filter of the drive circuit. In the present embodiment, the latched data is cleared in response to the output of the clear signal CLER as described above, and then generation of the drive waveform signal WCOM is started when the first clock signal ACLK is output. As shown in FIG. 13, in the case with the drive waveform signal WCOM having a shape of joining four drive pulses, the time period from the clear signal CLER to the first clock signal ACLK, namely drive pulse application timing initial values T(1) through T(4) have previously been defined. With respect to the liquid jet emission timing initial values T(1) through T(4), there are caused the delay time periods t(1) through t(4) in accordance with the number of the actuators to be driven, in other words, the number of the actuators connected to the drive pulse.

The number of the actuators to be connected to the drive pulse is previously known from the drive pulse selection data SI&SP. Therefore, in the present embodiment, the delay time periods t(1) through t(4) are stored in the delay time memory 115 as drive pulse application timing correction values t corresponding to the number of actuators connected to the drive pulse as shown in FIG. 14, and the drive pulses are applied to the actuators the drive pulse application timing correction values t earlier than the drive pulse application timing initial values T, the drive pulse application timing correction values corresponding to the number of the actuators to be connected to each of the drive pulses. Specifically, the generation timing itself of the drive waveform signal WCOM corresponding to the drive pulse is made earlier. It should be noted that the drive pulse application timing correction values t can be obtained by experiments, or obtained from the known capacitances of the actuators.

Figure 15:
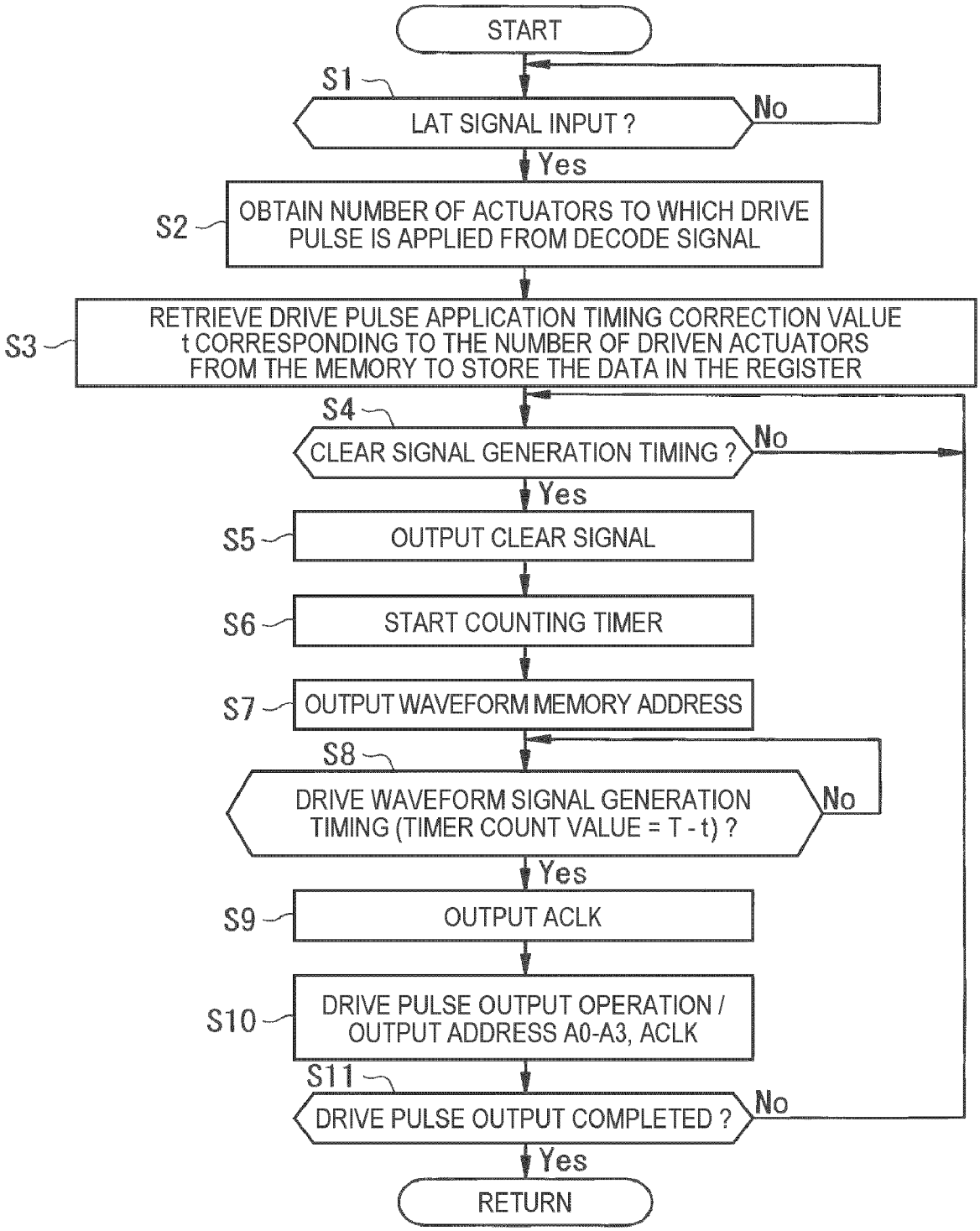
FIG. 15 is a flowchart showing an arithmetic processing for outputting address data and a first clock signal performed in a control circuit shown in FIG. 12.

FIG. 15 shows the arithmetic processing for outputting the first clock signal ACLK and the address data A0 through A3 performed in the control circuit 114 shown in FIG. 12. In the present arithmetic processing, firstly, whether or not the latch signal LAT is input is judged in the step S1, and if the latch signal LAT has been input, the process proceeds to the step S2, otherwise the process becomes the standby condition.

In the step S2, the number of the actuators, which are provided with each of the drive pulses and are driven by each of the drive pulses, is obtained from the drive pulse selection data SI&SP decoded by the decoder 113.

Subsequently, the process proceeds to the step S3, and the drive pulse application timing correction value t corresponding to the number of the actuators to be driven is retrieved from the delay time memory 115, and the data is stored in the register not shown.

Subsequently, the process proceeds to the step S4, and whether or not the clear signal CLER generation timing has been reached is judged, if the clear signal CLER has been reached, the process proceeds to the step S5, otherwise the process becomes the standby state.

In the step S5, the clear signal CLER is output.

Then, the process proceeds to the step S6 to start counting a timer.

Subsequently, the process proceeds to the step S7 to output the address data A1 of the waveform memory.

Then, the process proceeds to the step S8, and whether or not the generation timing of the drive waveform signal WCOM has been reached or not is judged using whether or not the count value of the timer is equal to the value subtracted by the drive pulse application timing correction value t from the drive pulse application timing initial value T, and if the generation timing of the drive waveform signal WCOM has been reached, the process proceeds to the step S9, otherwise the process becomes the standby state.

In the step S9, the first clock signal ACLK is output.

Subsequently, the process proceeds to the step S10, and drive pulse outputting operations such as outputting the address data A0 through A3 or outputting the first clock signal ACLK are performed.

Subsequently, the process proceeds to the step S11, and whether or not the output of the drive pulse has been completed is judged, and if the output of the drive pulse has been completed, the process proceeds to the main program, otherwise the process proceeds to the step S4.

Figure 16:
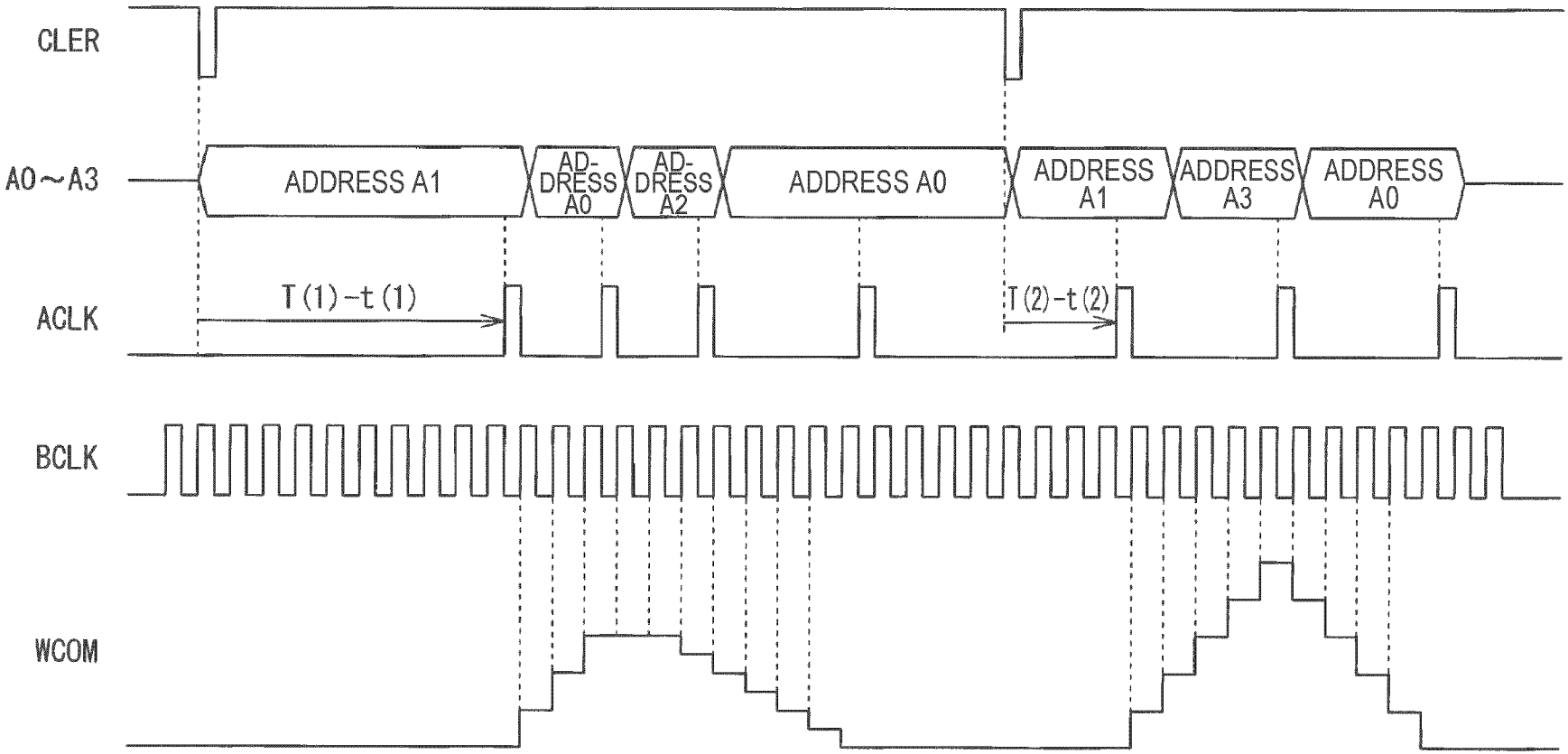
FIG. 16 is an explanatory diagram of a drive waveform signal by the arithmetic processing shown in FIG. 15.

According to the present arithmetic processing, as shown in FIG. 16, after the clear signal CLER is output, the address data A1 of the waveform memory is output, then the first clock signal ACLK is output after the time period obtained by subtracting the drive pulse application timing correction value t from the drive pulse application timing initial value T has elapsed, and from that time, the drive waveform signal WCOM corresponding to the drive pulse is generated. Since the drive waveform signal WCOM corresponding to the drive pulse is corrected in the phase delay of the drive pulse assuming the number of the actuators to be driven, the drive pulse is applied substantially in the set application timing, thus the liquid jet is emitted with an appropriate timing.

As described above, according to the present embodiment, since the drive pulse application timing correction values t corresponding to the number of the actuators to be driven have been stored, and the application timing (generation timing) of the drive pulse to the actuators is arranged to be corrected using the drive pulse application timing correction value t, which is corresponding to the number of the actuators to be driven and have been stored, it becomes easier to configure the drive circuit, and it is possible to compensate the phase delay in the drive pulse to make the liquid jet emitting timing appropriate.

It should be noted that although in the present embodiment, the example applying the present invention taking the line head printing apparatus as a target is only explained in detail, the liquid jet apparatus and the method of adjusting the phase of the drive pulse according to the present invention can also be applied to a multi-pass printing apparatus or any other types of printing apparatuses for printing letters or images on a print medium by emitting liquid jet as a target thereof. Further, each section configuring the liquid jet apparatus or the printing apparatus of the present invention can be replaced with an arbitrary configuration capable of exerting a similar function, or added with an arbitrary configuration.

Further, as a liquid emitted from the liquid jet apparatus of the present invention, there is no particular limitation, and liquids (including dispersion liquids such as suspensions or emulsions) containing various kinds of materials as mentioned below, for example. Specifically, ink containing a filter material of a color filter, a light emitting material for forming an EL light emitting layer in an organic electroluminescence (EL) device, a fluorescent material for forming a fluorescent substance on an electrode in a field emission device, a fluorescent material for forming a fluorescent substance in a plasma display panel (PDP) device, electrophoretic material for forming an electrophoretic substance in an electrophoretic display device, a bank material for forming a bank on a substrate W, various coating materials, a liquid electrode material for forming a electrode, a particle material for forming a spacer for forming a microscopic cell gap between two substrates, a liquid metal material for forming metal wiring, a lens material for forming a microlens, a resist material, a light diffusion material for forming a light diffusion material, and so on can be cited.

Further, in the present invention, the print medium to be a target of the liquid jet emission is not limited to a piece of paper such as a recording sheet, but can be a film, a cloth, a nonwoven cloth, or other medium, or works such as various substrates such as a glass substrate, or a silicon substrate.

What is claimed is:

1. A liquid jet apparatus comprising:

a plurality of nozzles provided to a liquid jet head;

a plurality of actuators provided so as to correspond to each of the nozzles; and drive unit that applies a drive pulse to each of the plurality of actuators, wherein the drive unit includes:

a correction value storing unit that stores a drive pulse application timing correction value corresponding to the number of actuators to be driven at the same time in order to compensate for an increased electrical interference generated by multiple actuators being driven at the same time, and drive pulse application timing correction unit that corrects the drive pulse application timing using the drive pulse application timing correction value corresponding to the number of actuators to be driven stored in the correction value storing unit at the same time.

2. The liquid jet apparatus according to claim 1, wherein the drive pulse application timing correction unit corrects drive pulse generation timing using the drive pulse application timing correction value corresponding to the number of the actuators to be driven.

3. A printing apparatus comprising:

a plurality of nozzles provided to a liquid jet head;

a plurality of actuators provided so as to correspond to each of the nozzles; and drive unit that applies a drive pulse to each of the plurality of actuators, wherein the drive unit includes:

correction value storing unit that corrects a drive pulse application timing correction value corresponding to the number of actuators to be driven at the same time in order to compensate for an increased electrical interference generated by multiple actuators being driven at the same time, and drive pulse application timing correction unit that corrects the drive pulse application timing using the drive pulse application timing correction value corresponding to the number of actuators to be driven at the same time, which is stored in the correction value storing unit.

4. The printing apparatus according to claim 3, wherein the drive pulse application timing correction unit corrects drive pulse generation timing using the drive pulse application timing correction value corresponding to the number of the actuators to be driven.

5. A method of adjusting a phase of a drive pulse of a liquid jet apparatus having a plurality of nozzles provided to a liquid jet head, a plurality of actuators which correspond to each of the nozzles, and drive unit that applies a drive pulse to each of the actuators, the method of adjusting a phase of a drive pulse comprising:

storing a drive pulse application timing correction value corresponding to the number of actuators to be driven at the same time in order to compensate for an increased electrical interference generated by multiple actuators being driven at the same time; and correcting the drive pulse application timing using the drive pulse application timing correction value corresponding to the number of actuators to be driven at the same time.

6. The method of adjusting a phase of a drive pulse of a liquid jet apparatus according to claim 5, wherein in the step of correcting the drive pulse application timing, the drive pulse generation timing is corrected using the drive pulse application timing correction value corresponding to the number of the actuators to be driven.

* * * * *